United States Patent [19]

Hoeffken

[11] Patent Number: 4,475,585

[45] Date of Patent: Oct. 9, 1984

[54] AIR CONDITIONING AND HEAT PUMP CABINETS WITH REMOVABLE COIL GUARDS

[75] Inventor: Russell W. Hoeffken, Belleville, Ill.

[73] Assignee: Snyder General Corporation, Red Bud, Ill.

[21] Appl. No.: 272,447

[22] Filed: Jun. 11, 1981

[51] Int. Cl.[3] ..... F28F 19/00

[52] U.S. Cl. ..... 165/134 R; 62/298; 165/76; 165/122

[58] Field of Search ..... 165/134 R, 122, 119, 165/76; 62/324 F, 531, 507, 449, 515, 259.1, 324.1, 298; 312/236, 1; D23/141, 153, 139; 98/114; 416/247

[56] References Cited

U.S. PATENT DOCUMENTS

| | | | |
|---|---|---|---|
| D. 148,542 | 2/1948 | Hutcheson | 416/247 X |
| 1,571,354 | 2/1926 | Whitacre . | |
| 1,631,846 | 6/1927 | Wilson . | |
| 1,788,721 | 1/1931 | Klomparens | 98/114 |
| 1,828,995 | 10/1931 | Brownell . | |
| 1,971,332 | 8/1934 | Cook | 416/247 |
| 2,263,510 | 11/1941 | Lindsay . | |
| 3,123,288 | 3/1964 | Franklin | 416/247 X |
| 4,153,310 | 5/1979 | Loving et al. . | |
| 4,261,418 | 4/1981 | Helt et al. | 165/134 R |

*Primary Examiner*—Sheldon J. Richter
*Assistant Examiner*—John F. McNally
*Attorney, Agent, or Firm*—Hubbard, Thurman, Turner & Tucker

[57] ABSTRACT

A cabinet for air conditioning or heat pump equipment is provided with resilient coil guards which can be flexed into and out of engagement with corner posts and struts that lend rigidity to the guards and are structural integrating members of the cabinet.

3 Claims, 10 Drawing Figures

Fig. 1
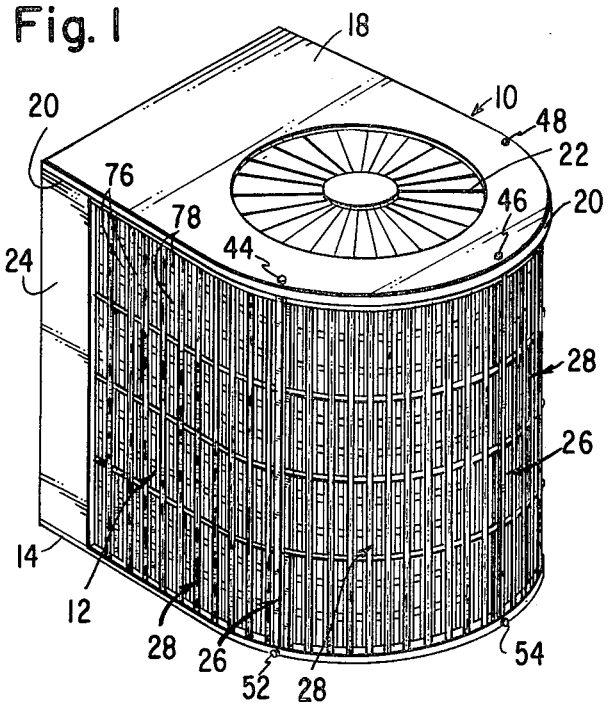
Fig. 2
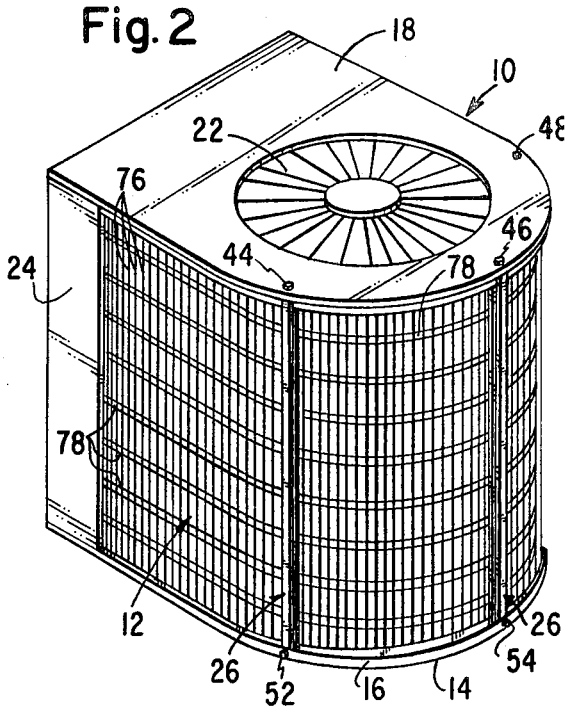
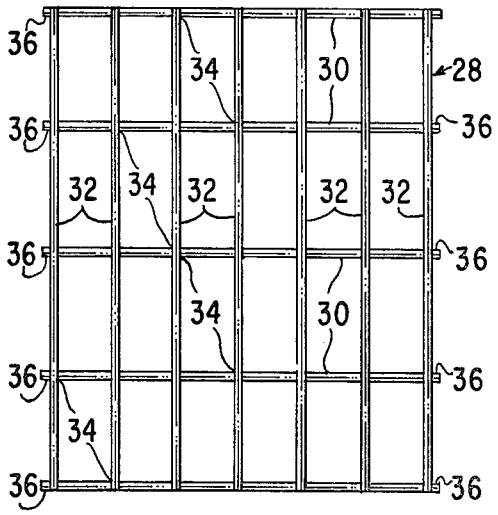
Fig. 3
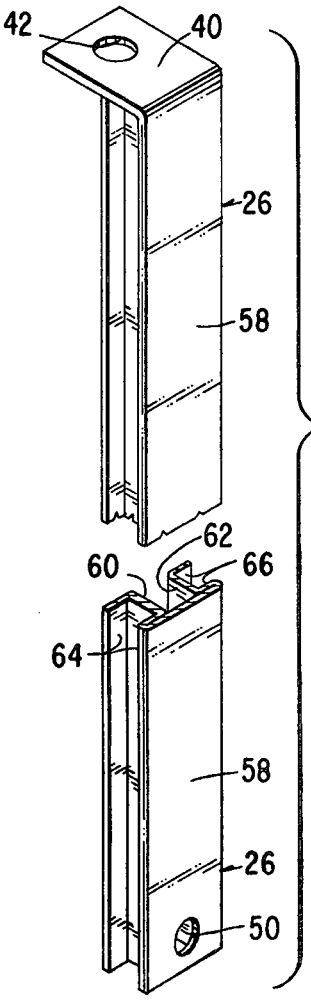
Fig. 4

AIR CONDITIONING AND HEAT PUMP CABINETS WITH REMOVABLE COIL GUARDS

DESCRIPTION

1. Field of the Invention

The invention relates to air conditioning and heat pump equipment and more particularly to cabinets therefor.

2. Description of the Prior Art

It is known for air conditioning and heat pump equipment to be housed in cabinets which include coil protecting means. The known coil protecting means have been constructed in various ways and have been variously configured. One such protecting means consists of a sheet steel guard reinforced with angles or brackets spotwelded thereto to provide the necessary strength to withstand on-coming objects. Another is a guard fabricated from sheet steel without reinforcing angles or brackets, and set out in front of a condensor coil at a distance greater than the amount the sheet metal may be deflected inwardly on impact. Such guard, being without reinforcement is likely to be marred by an unsightly dent when struck by a flying object. Some air conditioners are provided with a plastic guard which transmits the impact of shock to a broad area of a coil surface and serves to conceal damage rather than prevent it. It is also known to protect a coil of air conditioning or heat pump equipment with a welded wire guard. This type of guard is typically wrapped around a bent coil and fastened only at opposite ends to the cabinet containing the coil, thereby leaving the center to impact against the coil. In some cabinets, the wire guard is also affixed to top and bottom parts of the cabinet about the coil area. Nevertheless, such wire guards still flex inwardly on impact and are therefor a perceived rather than an actual coil protecting means.

Coil guards are usually attached to cabinets with screws, clips, or other fasteners requiring the use of hand tools. The fasteners and tools are costly. Furthermore, the fasteners must be undone to permit removal of the guard when access to the coil is required as, for example, when the coil needs cleaning. Because of the difficulty in performing such preventative maintenance, the task is often put off or omitted altogether, and a premature failure of the equipment may be experienced as a consequence.

It is a prime objective of this invention to provide an improved construction for air conditioning and heat pump cabinets permitting a coil guard to be easily attached to and removed from such cabinets without hand tools and the manipulation of screws, clips or other fasteners.

It is another object of this invention to provide air conditioning and heat pump cabinets with improved coil protecting means capable of withstanding substantial impact forces and preventing coil damage.

It is still another object of this invention to provide an improved construction for air conditioning and heat pump cabinets utilizing structural members of the units to support a removable coil guard and render the guard effective to withstand substantial impact forces without deflecting into engagement with and damaging the coil.

It is also an object of the invention to provide an improved construction for air conditioning and heat pump cabinets providing structural integrity for the cabinets in the absence of coil guards and enabling coil guards to be easily attached to the cabinets without the structural integrity thereof being disturbed in any way.

Other objects and advantages of the invention will become apparent during a reading of the specification taken in connection with the accompanying drawings.

SUMMARY OF THE INVENTION

In accordance with the invention, a cabinet for air conditioning or heat pump equipment is provided with coil guards which can be readily attached to or removed from the cabinet, and which afford a high degree of protection to a peripheral coil from on-coming objects. The guards are formed of resilient material and are flexed into and out of connecting engagement with receiving structural members that lend rigidity to the guards. The guards attach to and are removable from a cabinet without hand tools and the manipulation of screws, clips or other fasteners.

DESCRIPTION OF THE DRAWINGS

FIG. 1 is a perspective somewhat diagrammatic view of an air conditioning cabinet provided with coil guards in accordance with the invention;

FIG. 2 is a view similar to FIG. 1 with the coil guards removed;

FIG. 3 is an elevational view of a coil guard;

FIG. 4 is a perspective view of a strut utilized in the cabinet of FIGS. 1 and 2;

Figures 5, 5A, 6, 7, 8, 9:
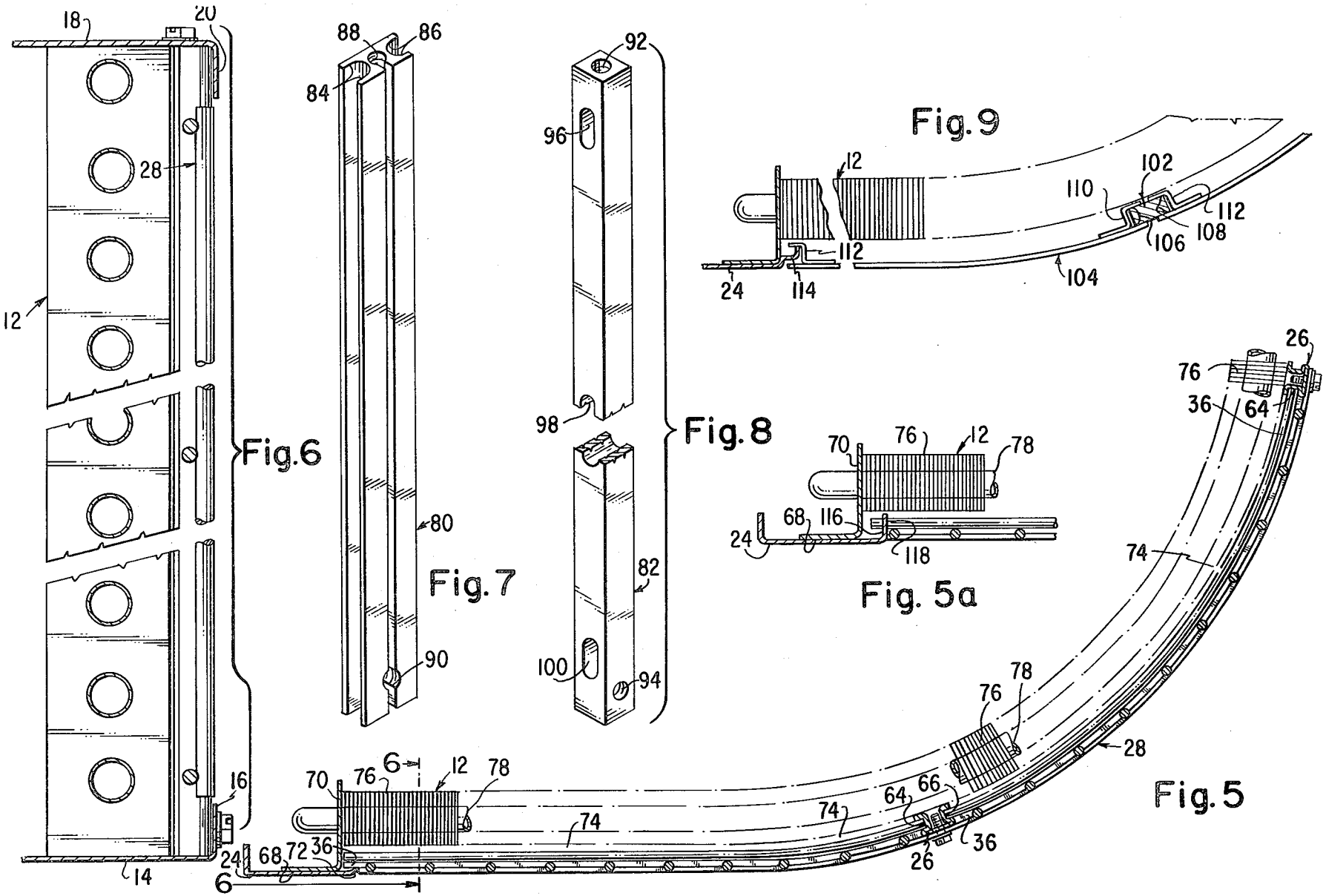
FIG. 5 is a fragmentary horizontal sectional view showing guards of FIG. 1 in relation to a coil protected by the guards.
FIG. 5*a* shows a modified portion of the structure depicted in FIG. 5.
FIG. 6 is a vertical sectional view taken on the plane of the line 6—6 of FIG. 5.
FIG. 7 is a perspective view of a modified strut.
FIG. 8 is a perspective view of another modified strut.

and,

FIG. 9 is a view similar to FIG. 5 showing still another modified strut and guards of sheet material.

DESCRIPTION OF THE PREFERRED EMBODIMENT OF THE INVENTION

Referring to the drawings, and in particular to FIGS. 1 and 2, reference character 10 designates an outdoor cabinet for air conditioning equipment including a bent peripheral condenser coil 12. The cabinet includes a sheet metal base 14 having an upturned flange 16 extending around its perimeter, and a sheet metal top plate 18 with a downturned marginal flange 20. The base 14 and top plate 18 have matching outlines which are in part curved to extend beyond coil 12. Top plate 18 is formed with a stamped out fan guard 22.

The cabinet which is symmetrical about a longitudinally extending vertical plane includes rear corner posts 24 between base 14 and top 18, and further includes struts 26 between the base and top of the cabinet at spaced intervals therearound. The corner posts 24 and struts 26 tie the base 14, top plate 18 and coil 12 together into a structurally integrated unit, and function as receiving, holding and supporting means for flexible resilient coil protecting guards 28.

The coil protecting guards 28 are preferably open mesh structures formed by welding perpendicularly crossed lengths of round wire 30 and 32 together at contacting points 34, and having one set of wires 30 extend at opposite ends beyond the other set of wires 32 to provide pins 36 receivable in the corner posts 24 and struts 26. While wire constructed guards are particularly suitable for use on cabinet 10, the guards may also be otherwise constructed. The guards, instead of being formed of wire, may, for example, be formed of sheet steel, or plastic materials may be used for their construction. The entire marginal edge of a sheet metal or sheet plastic guard may be inserted in a grooved corner post or strut, or such guards may be provided with tabs receivable in slots in the corner posts and struts.

Struts 26 are formed of sheet steel with a top flange 40. Such flange 40 includes a hole 42 through which the struts are bolted at 44, 46 and 48 to the top plate 18 of the cabinet. The struts are provided near the bottom with a hole 50 through which they are bolted as, for example, at 52 and 54 to the upturned flange 16 on the cabinet base 14. Each of the struts is a unitary structure having a front flange 58 and side channels 60 and 62. As such, the struts are stiff structural members which do not give way to bending forces. The side channels define grooves 64 and 66 wherein pins 36 of the coil guard 28 are receivable. The corner posts 24 abut one side 68 of a right angled coil end plate 70, and include end portion 72 which projects beyond the end plate. Pins 36 are receivable behind the projecting end portion 72 of the coil end plate. Alternatively, pins 36 may be received in holes or slots 116 provided in suitably formed end portions 118 of the corner posts 24 as shown in FIG. 5*a*, in which case, such end portions 118 may serve as engagement stops for the end wire members 32 of the coil guards 28.

The coil guards 28 are installed on cabinet 10 between struts 26 by first inserting the pins 36 at one end of a guard in a groove 64 or 66 of one strut, then flexing the guard to substantially align the pins 36 at the opposite end of the guard with the groove 66 or 64, respectively of the other strut, and finally permitting the aligned pins to enter the groove of the second strut. The coil guards are similarly installed between a strut 26 and corner post 24. Pins 36 at one end of a guard may be first inserted as in the groove 64 of the strut, and after flexure of the guard the pins at the opposite end of the guard would be inserted behind the end portion 72 of the post, or into holes or slots 116 in end portion 118 of the post. Alternatively, the guard may be first connected to the post, and after flexure to the strut. The guards 28 are readily removed from the cabinet 10, it only being necessary to first flex a guard to remove one end from a strut, or from an end post. Then the guard can be separated from the cabinet without difficulty.

The guards 28, when installed, are spaced as shown at 74 from the fins 76 of the coil 12 carried on the coil piping 78, and afford protection to the coil from objects impacting against a guard. The struts which are stiff structural members support the guards at predetermined intervals effective to prevent the guards from deflecting or caving in and forcibly engaging the coil fins 76 even when subjected to rather large impact forces. The impact forces instead of forcing the guards inwardly against the coil are transmitted to the structurally sound struts and the integrity of the coil is therefor maintained.

FIGS. 7 and 8 show struts 80 and 82 which are configured somewhat differently from the struts 26 described hereinbefore, but which are intended to serve the same function as the struts 26 and may be substituted therefor. Strut 80 is an extruded member having channel grooves 84 and 86 to receive the pins 36 of coil guard 28. The strut is provided with holes 88 and 90 to receive bolts by means of which the part may be secured to the top and bottom respectively of cabinet 10. Strut 80 is a stiff member having a configuration in cross-section which is generally similar to an I-beam. Strut 82 is a stiff member with a rectangular cross-section. Strut 82 may be extruded, and like strut 80 may be formed from any one of a variety of materials such as aluminum, steel and plastic. Strut 82 includes top and bottom holes 92 and 94, respectively. The strut is also provided with through slots 96, 98 and 100 or holes for receiving the pins of a coil guard or possibly sheet metal tabs if the coil guard is constructed of sheet metal.

FIG. 9 shows a rectangular strut 102 which is without grooves, holes or slots for receiving pins or the like on coil guards. Such struts are utilized in association with coil guards 104 of flexible sheet material which are provided with end channels 106 and 108 formed thereon by angles 110 and 112, respectively. The end channels embrace side edge portions of struts 102 in assembled positions of the coil guards. A suitably formed end portion 114 of a corner post 24 is also received in an end channel of a coil guard 104.

It is to be understood that the present disclosure relates to preferred embodiments of the invention which are for purposes of illustration only, and that various modifications may be made therein without departing from the spirit and scope of the invention as defined in the appended claims.

I claim:

1. A cabinet for air conditioning, heat pumps or like equipment including a heat exchanging peripheral coil, a base member, a top plate member, and spaced apart substantially stiff structural members extending between and secured to said base and top members and including a plurality of spaced apart apertures formed therein for engagement with at least one coil guard adapted to be mounted on said cabinet and disposed across a space formed between said structural members, said coil guard comprising a flexible member characterized by sets of spaced apart crossed lengths of interconnected wire members, one set of said wire members extending in one direction and having end portions projecting beyond another set of wire members extending in another direction, said end portions of said wire members extending in said one direction forming pins, each of said pins are insertable in one of said apertures, respectively, said coil guard being separated from said structural members by flexing said coil guard to remove said end portions of said one set of wire members from said apertures, and said coil guard being mounted on said cabinet by flexing said coil guard and reinserting said end portions of said one set of wire members into engagement with said apertures, respectively, and whereby the flexure of said coil guard comprises the sole means of mounting said coil guard on and removing said coil guard from said cabinet.

2. A cabinet for air conditioning, heat pumps or like equipment including a heat exchanging peripheral coil, spaced apart first and second members forming a portion of said cabinet, and spaced apart substantially stiff parallel structural members secured to and extending between said first and second members and extending along and adjacent to said coil, said structural members each including a plurality of spaced apart apertures formed therein for engagement with at least one coil guard adapted to be mounted on said cabinet and disposed across a space formed between said structural members, said coil guard comprising a flexible member characterized by sets of spaced apart cross lengths of interconnected wire members, one set of said wire members extending in one direction having end portions projecting beyond another set of wire members extending in another direction, said end portions of said wire members extending in said one direction forming pins, each of said pins are insertable in one of said apertures, respectively, said coil guard being separated from said structural members by flexing said coil guard to remove said end portions of said one set of wire members from said apertures, and said coil guard being mounted on said cabinet by flexing said coil guard and reinserting said end portions of said one set of wire members into engagement with said apertures, respectively, and whereby said flexure of said coil guard comprises the sole means of mounting said coil guard on and removing said coil guard from said cabinet.

3. A cabinet for air conditioning, heat pumps or like equipment including a heat exchanging peripheral coil, a base member, and a top plate member, spaced apart substantially stiff structural members extending between said base and top members and including parts adapted to be in engagement with at least one coil guard adapted to be mounted on said cabinet and disposed across a space formed between said structural members, said coil guard comprising a member formed of sheet material, and opposed elongated angle section members secured to opposite edges of said member formed of sheet material and forming channels cooperable with side portions of said structural members, respectively, whereby said side portions of said structural members are received in said channels formed by said angle section members and said member formed of sheet material when said coil guard is mounted on said cabinet, said coil guard being separated from said structural members by flexing said member formed of sheet material to remove said coil guard including said angle section members from said cabinet, and said coil guard being mounted on said cabinet by flexing said member formed of sheet material to insert said side portions of said structural members, respectively, into said channels formed by said angle section members and said member formed of sheet material whereby the flexure of said member formed of sheet material comprises the sole means of mounting said coil guard on and removing said coil guard from said cabinet.

* * * * *